US009756951B1

(12) United States Patent
Stewart, Jr.

(10) Patent No.: US 9,756,951 B1
(45) Date of Patent: Sep. 12, 2017

(54) COMPRESSIBLE FOAM FOUNDATION FOR MATTRESS SUPPORT

(71) Applicant: James O. Stewart, Jr., Jackson, MO (US)

(72) Inventor: James O. Stewart, Jr., Jackson, MO (US)

( * ) Notice: Subject to any disclaimer, the term of this patent is extended or adjusted under 35 U.S.C. 154(b) by 0 days.

(21) Appl. No.: 15/499,077

(22) Filed: Apr. 27, 2017

Related U.S. Application Data

(60) Provisional application No. 62/415,534, filed on Nov. 1, 2016.

(51) Int. Cl.
*A47C 19/12* (2006.01)
*A47C 19/02* (2006.01)
*A47C 31/00* (2006.01)

(52) U.S. Cl.
CPC ..... *A47C 19/12* (2013.01); *A47C 19/025* (2013.01); *A47C 31/001* (2013.01)

(58) Field of Classification Search
CPC ..... A47C 19/12; A47C 19/025; A47C 31/001; A47C 27/14; A47C 27/142; A47C 27/146; A47C 27/16; A47C 27/088; A47C 27/18; A47C 27/084
See application file for complete search history.

(56) References Cited

U.S. PATENT DOCUMENTS 2,878,494 A * 3/1959 Healy ..... A47C 27/144 5/722
3,268,922 A * 8/1966 Moxley ..... A47C 17/82 224/235
3,370,306 A * 2/1968 Lovette ..... A47C 21/06 5/659
3,513,491 A 5/1970 Gordon
3,872,525 A * 3/1975 Lea ..... A47C 27/084 5/671
3,973,281 A 8/1976 Davis
4,025,974 A * 5/1977 Lea ..... A47C 27/084 5/709
4,106,139 A 8/1978 Southard
4,134,166 A 1/1979 Schuder
4,181,991 A 1/1980 Morgan
4,389,961 A * 6/1983 Parish ..... A47C 27/084 114/345
4,711,067 A 12/1987 Magni
(Continued)

*Primary Examiner* — Eric Kurilla
(74) *Attorney, Agent, or Firm* — CreatiVenture Law, LLC; Dennis J M Donahue, III

(57) ABSTRACT

A foundation for a mattress is formed from a foam block and supports that extend across the bottom side of the foam block. The supports are preferably secured within channels in the bottom side of the foam block and can be attached to the foam block by an adhesive. The foam block is made of foam rigid enough to support a mattress and is compressible so it has a compressed configuration and an expanded configuration. In the compressed configuration, the foundation may be folded into a compact form and vacuum-sealed in a plastic membrane which easies in storage, shipping, and delivery of the foundation. When the foundation is delivered to its place of use, the compressed foundation can be removed from its packaging, allowing the foam block to return to its expanded configuration and placed onto a standard bed frame with the supports providing crosswise support across the frame.

18 Claims, 5 Drawing Sheets

(56) References Cited

U.S. PATENT DOCUMENTS 4,928,337 A * 5/1990 Chauncey ..... A47C 27/001 5/722
5,111,542 A * 5/1992 Farley ..... A47C 27/148 5/727
5,231,714 A 8/1993 Mossbeck
5,469,589 A 11/1995 Steed
5,524,307 A 6/1996 Griffin
5,533,218 A * 7/1996 Fahy ..... A47C 27/144 5/421
5,681,090 A 10/1997 St. Thomas
5,701,653 A 12/1997 Rupe
5,983,423 A 11/1999 Rupe
6,061,856 A * 5/2000 Hoffmann ..... A47C 27/148 5/706
6,098,378 A 8/2000 Wyatt
6,662,393 B2 12/2003 Boyd
6,832,397 B2 12/2004 Gaboury
6,901,722 B2 6/2005 Dextraze et al.
7,293,311 B2 11/2007 Baker
7,334,280 B1 2/2008 Swartzburg
8,158,249 B2 4/2012 Greer
8,250,689 B2 8/2012 Gladney
8,347,588 B2 1/2013 Oh
8,443,974 B2 5/2013 Oh
8,528,132 B2 9/2013 De Bock
8,990,979 B1 3/2015 Craver
9,259,099 B1 2/2016 Larsen
9,655,456 B2 * 5/2017 Boyd ..... A47C 27/10
2003/0009830 A1 * 1/2003 Giori ..... A47C 27/084 5/709
2004/0055086 A1 3/2004 Owens, Jr.
2004/0074007 A1 * 4/2004 Gladney ..... A47C 27/20 5/727
2005/0000026 A1 1/2005 Gladney
2006/0075569 A1 * 4/2006 Giori ..... A47C 27/084 5/709
2006/0123551 A1 * 6/2006 Hsia ..... A47C 23/06 5/706
2008/0235868 A1 10/2008 Snitzer
2008/0263772 A1 * 10/2008 Chiu ..... A47C 4/54 5/654
2009/0144903 A1 6/2009 Delvaux
2010/0146706 A1 6/2010 Siegner
2013/0145555 A1 * 6/2013 Hargreaves ..... A47C 27/144 5/655
2014/0059769 A1 3/2014 Baker
2016/0000231 A1 * 1/2016 Auell ..... A47C 27/084 5/420

* cited by examiner

COMPRESSIBLE FOAM FOUNDATION FOR MATTRESS SUPPORT

CROSS-REFERENCE TO RELATED APPLICATIONS

This application is a utility application claiming priority from U.S. Provisional Patent Application No. 62/415,534 filed Nov. 1, 2016, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to foundations for mattresses, and more particularly to foundations made of foam that may be compressed and folded into dimensions more suitable for shipping and storage.

Related Art

Prior art mattress foundations have typically been produced using hard materials like wood and plastic which must be assembled before they are able to support a mattress. These known mattress foundations typically consist of a rectangular frame with a series of slats spanning the width of the rigid frame so that the foundation frame sits on and spans a standard bed frame and a mattress is supported by the slats on the top side of the foundation. Other types of known foundations substitute the series of slats for one or more cross beams or a single sheet of rigid material which may be known as a platform mattress foundation. Additionally, some known mattress foundations combine the rigid frame and cross members with supporting springs and are known as "box springs." These box springs are designed to provide more ergonomic support as they may flex when certain amounts of force are applied to the supported mattress, but the rigidity of the frame and stiffness of the springs still prevent folding and compression that equates to the compactness of the compressible foam mattress foundation described herein. Some of these mattress foundations with rigid support members can be disassembled for easier storage, shipping, and delivery, but these rigid foundations must then be assembled for use.

Some current mattress foundations include foam as a primary support material for the mattress rather than the rectangular frame with slats as described above. However, these foam foundation assemblies include a rigid panel base that spans the entire area within the periphery of the foam block (lengthwise and crosswise). For example, U.S. Pat. No. 4,106,139 discloses a foam foundation, but the panel base connected to the foundation within the cover is rigid and prevents the foundation from being folded for easier shipping and storage. As seen in US Pat. Pub. No. 2004/0055086, separate foam foundation modules have individual panel bases that are connected together by hinged fasteners that allow the modules to be folded. Although adjacent panel bases are connected together by fasteners, foam blocks in adjacent modules are not connected in order to permit the modules' adjacent panel bases to be folded together at the hinged fasteners without folding the foam blocks. The folded foundation modules can be stored, shipped, and delivered and then unfolded when ready for use. The folding of the modules reduces the length of the packaged foundation which helps in the delivery of each foundation but does not necessarily reduce the volume of space it takes for storing and shipping a large group of foundations.

Although the foldable foam-panel modules disclosed by the '086 application may have an advantage over the unfoldable foam-panel structure disclosed by the '139 patent by helping in the delivery of foam foundations, it also introduces discontinuities in the support of the mattress because of the multiple sections of foam. None of the prior art references consider using a single, unitary foam block for a foundation with multiple separate support beams that are not directly connected to each other but are only connected to each other through their attachment to the unitary foam block. Prior to the present invention, the conventional thoughts in the bedding industry had been that panels should cover the entire surface area within the periphery of the foam block to properly support the foam block and avoid sagging due to lack of some rigid support across the entire lengthwise and crosswise dimensions of the panel. Even in the '139 patent which has a corrugated bottom surface with grooves in the surface which do not contact the panel, the panel or some other structural support spans the entire surface area within the foam block's periphery, lengthwise and crosswise, and provides rigidity to the foundation assembly in both the lengthwise and crosswise dimensions.

It has also been known to compress and fold foam mattresses so that they can be stored, shipped, and delivered in a compact form. However, prior to the present invention, the bedding industry has never been able to both compress and fold foam foundations to the same degree as foam mattresses because the rigid panels or outer rigid framework with interior slats that have traditionally been used for foam foundations had required the rigidity in both the lengthwise and the crosswise dimensions. There has remained a need for a foam foundation that could be folded and compressed to be stored, shipped, and delivered in a compact form and then unfolded and expanded into a usable configuration that provides support to the mattress and has sufficient rigidity spanning the bed frame in either a lengthwise or crosswise dimension to avoid sagging. It would be beneficial to have a compressible foam foundation that does not require a lengthwise and crosswise rigid frame or panels beneath the foam block, or does not require a frame that must be assembled before the foundation can be used.

BRIEF DESCRIPTION OF THE DRAWINGS

The present invention will become more fully understood from the detailed description and the accompanying drawings, wherein FIGS. 1-5 generally illustrate the invention as particularly described below.

DETAILED DESCRIPTION OF THE PREFERRED EMBODIMENTS

Figure 1A:
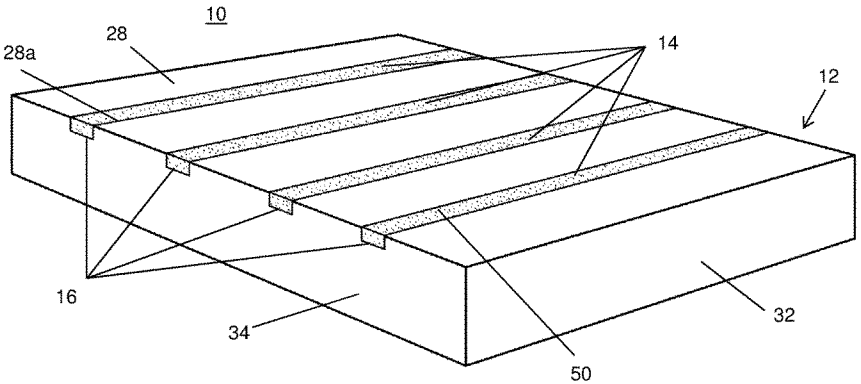
FIG. 1A shows a bottom view of an uncovered foam foundation for a mattress with crosswise supports.

The following description of the preferred embodiment(s) is merely exemplary in nature and is in no way intended to limit the invention, its application, or uses.

A foundation 10 for a mattress made up of a foam block 12 that is preferably a unitary single foam block with a plurality of rigid crosswise support sections 14. The foam block is made of a compressible and flexible firm foam 72 having a density of 0.85-5.0 pounds per cubic foot and having an indentation force deflection ("IFD") between thirty-nine and ninety-five pounds per cubic foot (39-95 PCF) which has sufficient firmness and strength to support a mattress but is not rigid so that the foam block may still be compressed and is flexible enough to bend both laterally and longitudinally. The foam is preferably polyurethane or any other firm foam that both compressible and flexible.

The foam block has an expanded configuration 42 in which the foam block reaches its full thickness 44*b* and a compressed configuration 40 in which the foam block is pressed down to a reduced thickness 44*a*. The reduced thickness is less than half of the expanded thickness and is preferably between 15% and 25% of the expanded thickness. In the expanded configuration, the foam block supports a mattress and may be produced to the length and width dimensions that accommodate mattresses of various sizes. Typically, these dimensions will conform to traditional mattress and mattress foundation sizes, namely twin, full, queen, king, California king, etc. However, traditional bedding sizes are not intended to be limiting, and the foundation size may vary in dimension relative to the mattress intended to be supported, including custom dimensions not traditionally used in the bedding industry.

Typically, foundations have a low profile thickness between five and eight inches (5"-8") or a high profile thickness between nine and twelve inches (9"-12") when expanded to their full thickness. When the foam block is compressed, the reduced thickness is approximately between two and three inches (2"-3"). It will be appreciated that the reduced thickness is primarily dependent on the full thickness of the foam block but the IFD of the foam could also play a factor in the amount to which the foam can be compressed, particularly depending on the equipment that is used to compress the foam. The compression of the foam block is primarily unidirectional so that the compressed configuration and the expanded configuration have nearly the same lateral width 36 between the pair of foundation sides 34 and longitudinal foundation length 38 between the head side 30 and the foot side 32.

Another aspect of the foam foundation are the crosswise supports connected to the foam block's bottom side 28. These crosswise rigid supports 14 act as a skeletal structure and provide rigid structure to the foam foundation 10, but the supports are thin enough (less than 2" or 3") to allow the foundation to be compressed to its reduced thickness, and there is no rigid connection between the crosswise supports so that the flexible foam block can be rolled with the rigid supports into the preferred shipping arrangement. The crosswise supports preferably extend laterally across the foam block so that the foam block rolls in the longitudinal direction around the foam block's lateral axis which results in the most compact configuration of the compressed and rolled foam foundation. The crosswise rigid supports may be any number of shapes including but not limited to beams, slats, rods, and planar sheets. Additionally, the crosswise supports may be made from any number of rigid materials including but not limited to wood, plastic, metal, hardened foam, and other similar materials. The crosswise supports preferably traverse the entire width of the foundation and are substantially perpendicular to the side edges while remaining substantially parallel to one another. Additionally, the crosswise supports extend between the sides of the foundation so that they can be placed onto a standard bed frame and provide crosswise support across the span of the frame. Preferably, the crosswise supports are connected to the foam block during manufacture prior to shipping, but the foam foundation and crosswise supports can alternatively be shipped together in an unattached arrangement. In another alternative arrangement, foam foundation can be shipped on its own, and a user may provide their own crosswise supports for connection to the foam foundation.

It is generally an aspect of the foam foundation to have crosswise supports spaced apart from each other by a distance 46. The crosswise supports provide crosswise rigidity to the foundation and are flexibly connected to each other through contiguous portions of the single flexible foam block that extend between adjacent crosswise supports; they are not rigidly connected. The spaced distance will vary based on the number of crosswise supports included in the foundation and its size and the shape of the crosswise supports. In spacing the crosswise supports from each other, the distance separating the supports has a range that is preferably greater than the reduced thickness 44*a* of the foam block 12 and less than the foam block's lateral width 36. The minimum distance depends on the flexibility of the foam, particularly in the compressed configuration, and allows the foam block's compressed configuration to be folded, and the maximum distance depends on the expanded foam block's strength and firmness, and prevents the foam block from sagging between the rigid crosswise supports.

Figure 1B:
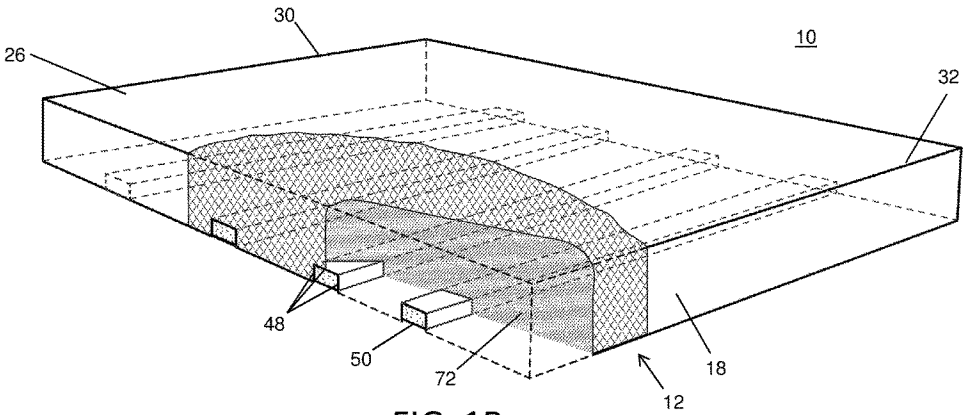
FIG. 1B shows a partial cutaway top view of a foam foundation for a mattress with crosswise supports and a cover.

As shown in FIGS. 1A and 1B, the foam block preferably has channels 16 recessed into its bottom side, and the crosswise supports fit into the channels. The channels can be cut into the bottom side of the foam block or formed into the foam block's bottom side, and in either case, the channels extend the entire width of the foam block between the sides. Additionally, the channels are spaced apart at locations corresponding with the distance between the crosswise supports. Preferably, the dimensions of the crosswise support are substantially equivalent to the channels' dimensions such that the length, width and thickness of the supports are equal to or slightly larger than the channel length, channel width, and channel depth. Accordingly, the crosswise supports can be friction fit 68 within the channels or can be fixed within the channels with an adhesive 66 as the crosswise supports have sides 48 that contact the walls of the channel. The crosswise supports are preferably square with four (4) sides, and three (3) of the sides are in contact with the walls of the channels while the fourth outer-facing side 50 is not in contact with any of the channels' walls. It will be appreciated that different shaped crosswise supports may be used, including but not limited to circular supports or triangular supports, but the outer-facing sides are preferably flush with the foam foundation's bottom surface 28*a* when in the expanded configuration.

Figure 2A:
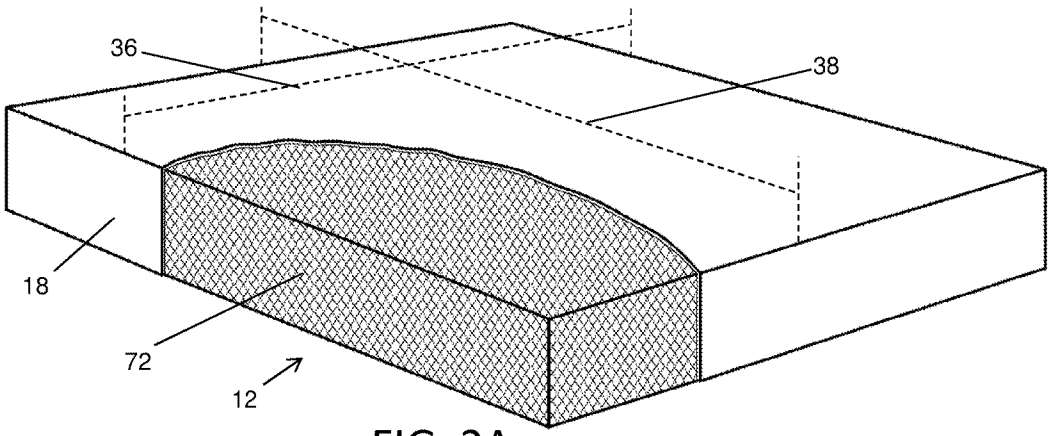
FIG. 2A shows a partial cutaway top view of a covered foam foundation for a mattress without crosswise supports.
Figure 2B:
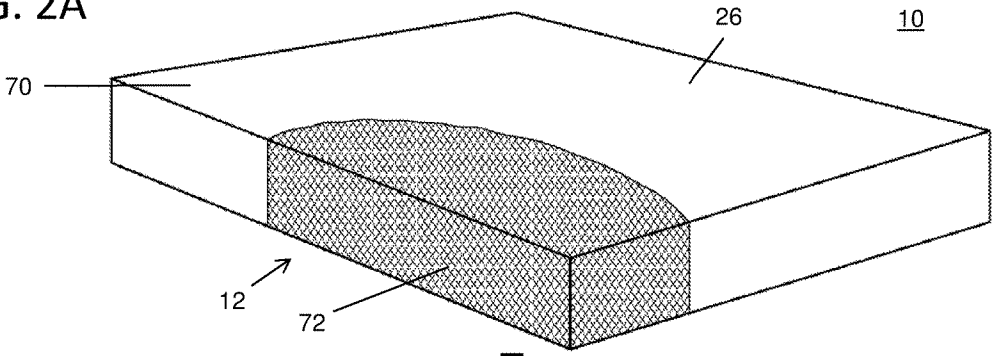
FIG. 2B shows a partial cutaway top exploded view of a foam foundation for a mattress with crosswise supports and a cover.
Figure 2B:
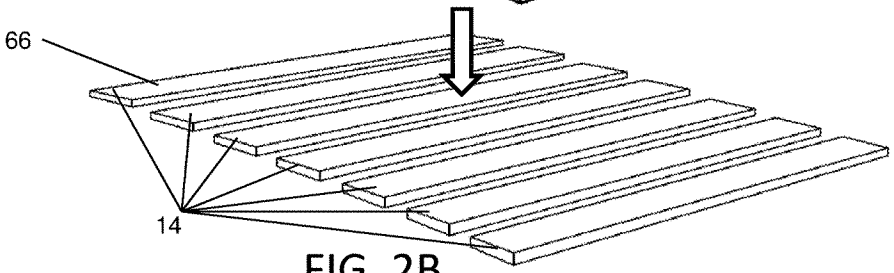

According to the embodiment shown in FIG. 2, the foam foundation 10 does not have channels 16 recessed into its bottom side 28, and narrow crosswise supports 14 can be connected directly to the foundation's bottom surface 28*a* with an adhesive 66. In this embodiment, the crosswise supports are preferably planar in shape and are attached to the bottom surface of the foam foundation along a single side. It will be appreciated that supports having a non-planar shape can also be used. Accordingly, the crosswise supports in this embodiment may not be substantially flush with the bottom surface of the foam foundation. The foam foundation and crosswise supports may be attached during manufacture or shipped as a kit.

In another aspect of the present invention, a cover 18 envelopes the foam block 12 as shown in FIGS. 1B, 2A, and 2B and also preferably envelops the crosswise supports 14 as shown in FIG. 1B. In yet another aspect of the present invention, the compressed configuration of the foam foundation 10 is encased by a plastic membrane 20 as shown in FIG. 3C. Accordingly, the foam block, cover and plastic membrane collectively form the packaged foundation assembly 58 discussed below. The cover is preferably removable to allow easy washing and replacement, but it may alternatively be permanently sewn over the foam block and crosswise supports. Different fasteners can be used to secure a removable cover around the foundation, including but not limited to zippers, hook and loop fasteners, snaps, buttons, and other similar closing and securing means. The cover is preferably made from a flame retardant material 70 or a material or combination of materials that pass or exceed the Federal Law 16 C.F.R. 1633 flammability standard to help make the foam foundation flame retardant.

Figure 3A:
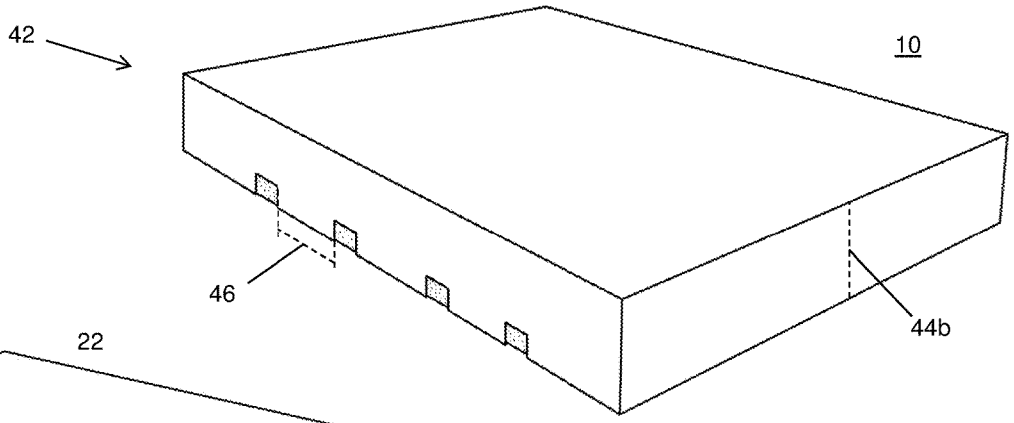
FIG. 3A depicts a foam foundation for a mattress in the expanded configuration.
Figure 3B:
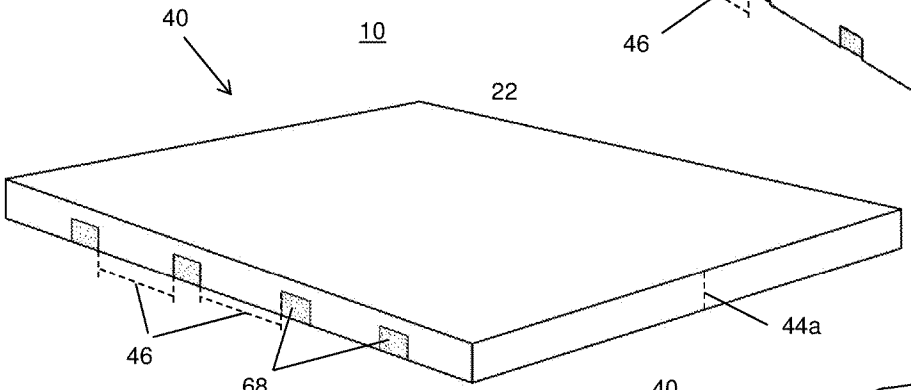
FIG. 3B depicts a foam foundation for a mattress in the compressed configuration.
Figure 3C:
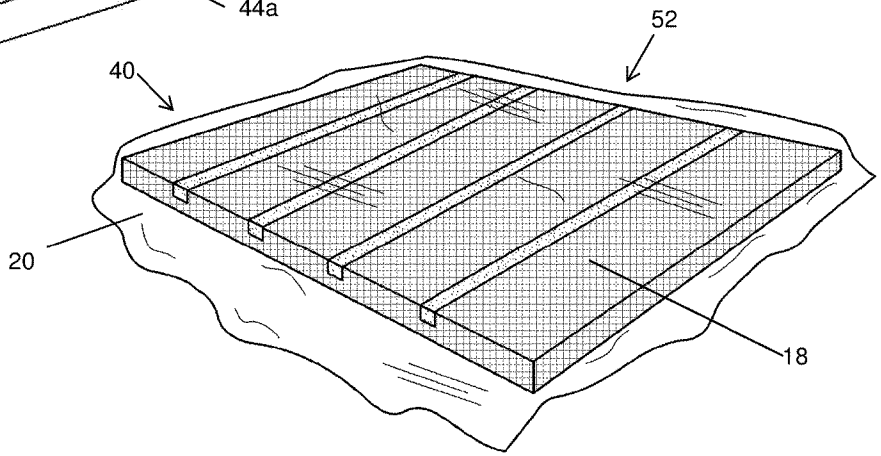
FIG. 3C depicts a foam foundation for a mattress in the compressed configuration encased in a plastic membrane.
Figure 4A:
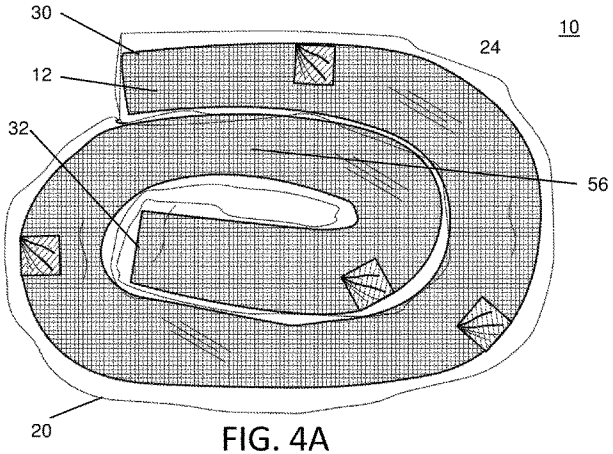
FIG. 4A depicts a foam foundation for a mattress in a compact forms.

Prior to compressing the foam block as shown in FIG. 3A, the plastic membrane 20 can be placed over the foundation, and once the foam block is in the compressed configuration 40 as shown in FIG. 3B, a vacuum can be drawn and the plastic membrane can be sealed. The vacuum seal can help sustain the compressed configuration as the flexible foam block bends as it is rolled into a coil shape or otherwise wrapped or folded and packaged for storage, shipment, and delivery. Collectively, the foam block 12, preferably with the crosswise supports 14, the cover 18, and the plastic membrane 20 form a packaged foundation assembly 58. It will be appreciated that the foam foundation and packaged foundation assembly has an opened arrangement 22 and a folded arrangement 24. In the opened arrangement, the compressed packed foundation assembly has a planar form 52 as depicted in FIGS. 1-3. In the folded arrangement, the flexible foam material bends between the rigid crosswise supports, and the foam block's head side and the foot side overlap its center section 56 as shown in FIG. 4. When folded, the packaged foundation assembly is in a compact form 54 and is secured by shipping material 60 for optimized storage, shipping and easier delivery, especially through constriction points, such as doors, stairwells, or vehicle cargo space.

Figure 4B:
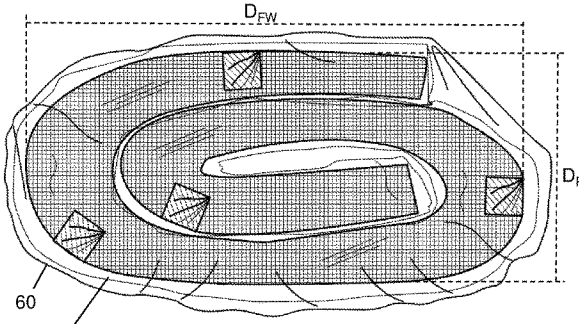
FIGS. 4B and 4C depict a foam foundation for a mattress in a compact form placed in a shipping material, a plastic bag and carton respectively.
Figure 4C:
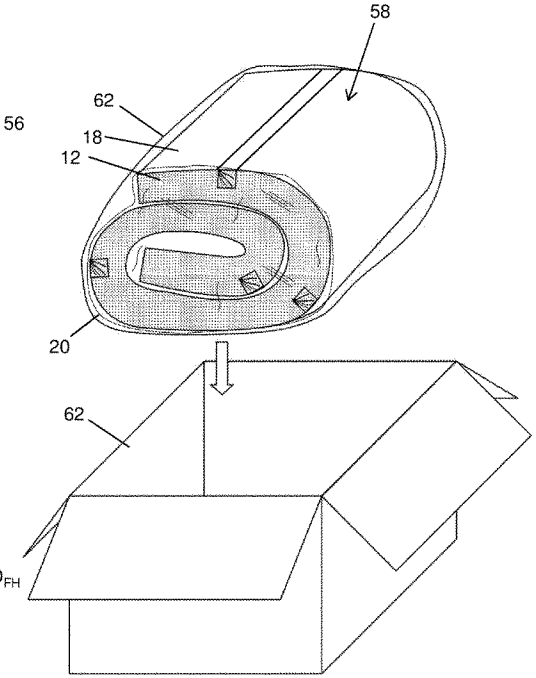

The crosswise supports maintain the rigidity of the foam foundation in the direction of the supports' axes so that the foundation can only fold around the supports' crosswise axes. Depending on the number of crosswise supports and the flexibility of the foam, the number of overlapping sections in the folds can vary. Generally, the packaged foundation assembly in its compact form has a folded height and a folded width that fit within boxes with the longest dimension being slightly larger than the width of the foam block between its sides and the other dimensions being less than half of this longest dimension. As shown in FIG. 4B, a foam foundation, compressed from its full thickness between nine and twelve inches (9"-12") down to a reduced thickness between two and three inches (2"-3"), has a compact form with a folded height $D_{FH}$ of approximately ten inches (10") which is less than twice the thickness of the full thickness of the uncompressed foam block and a folded width $D_{FW}$ of approximately twenty inches (20") which is less than the lateral width of the foam block. Once the foam foundation is in its compact form, it is ready to be packaged for shipment in the shipping material 60 which can be any of several appropriate shipping materials, such as stretch-wrapped plastic, shrink-wrapped plastic, preformed plastic bags, straps, or twine. The packaged foundation assembly is preferably placed in a shipping container 62, such as a cardboard box, for shipment. For example, as shown in FIG. 4C, the compressed and folded foam foundation in the pressure-sealed plastic can be placed into an outer plastic bag 60 and then packed in a heavy corrugated cardboard carton 62. The shipping material is preferably strong enough to keep the foundation in its compressed state in the event that the vacuum-seal breaks during shipping or while in storage.

Figure 5:
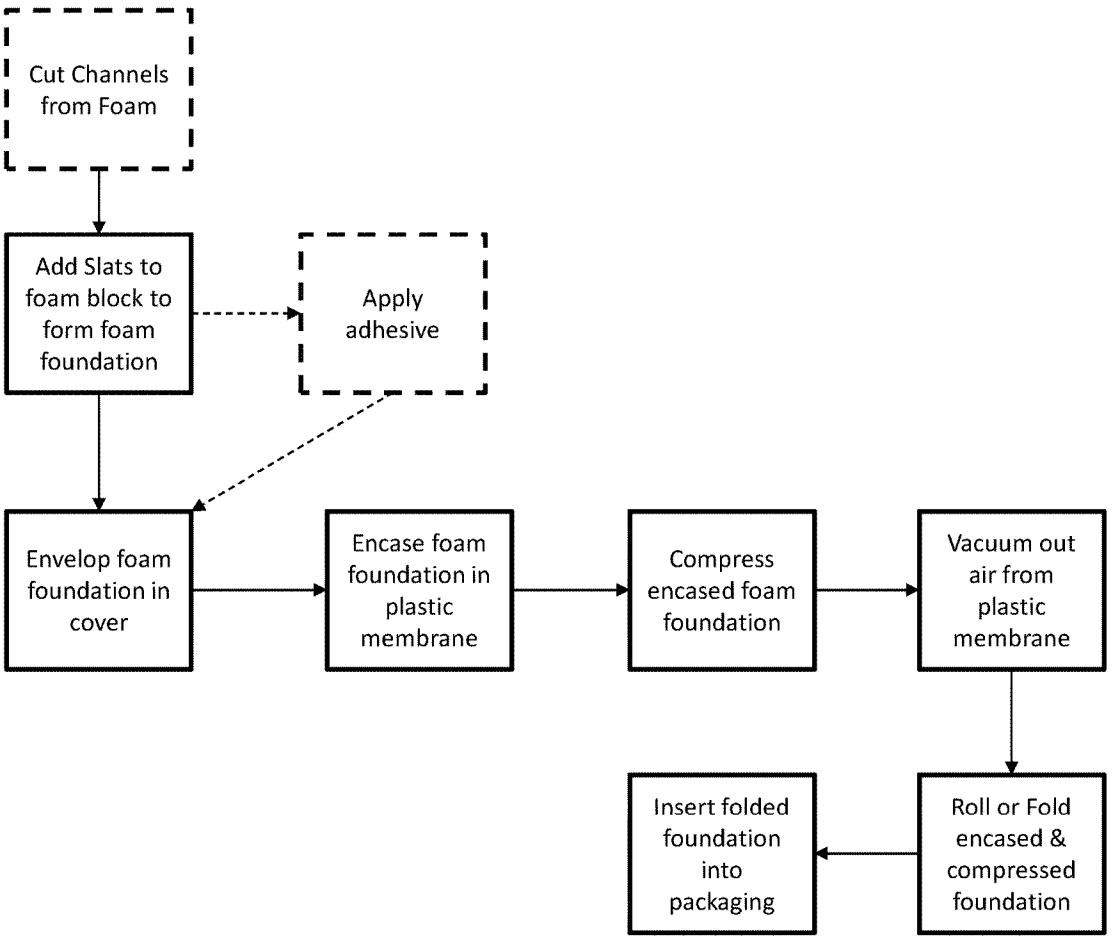
FIG. 5 illustrates the steps in the method for preparing a foam block for a mattress foundation.

The present invention also provides for an inventive method for preparing a foam block for a mattress foundation as shown in FIG. 5 and according to the steps listed below.

- Envelop the foam block with the cover while the foam block is in the expanded configuration.
- Encase the foam block and the cover in the plastic membrane (which collectively form the packaged foundation assembly).
- Compress the foam block in the packaged foundation assembly into its compressed configuration.
- Vacuum-seal the plastic membrane.
- Fold the packaged foundation assembly into its folded arrangement.
- Pack the compressed and folded packaged foundation assembly into a packing material and a shipping container for shipping and/or storage.

Generally, the above method describes how the foam foundation goes from the factory to the user with easier shipping, storage, and delivery in the compact form compared to the large and rigid prior art foundations. The vacuum-sealed plastic membrane, packing material, and shipping container are used to facilitate the shipping, storage, and delivery of the foam foundation. The compression of the foam may occur through any number of means, but pressure is preferably applied to the foundation while in the plastic membrane until the foam block reaches the desired compressed configuration. Once this compressed configuration is achieved, the plastic membrane is vacuum sealed and the pressure is removed.

The compressed vacuum-sealed foundation is folded or rolled into its folded arrangement described above, and the vacuum-sealed plastic membrane helps maintain the foam block in its compressed configuration. The packaging material surrounding the folded, compressed vacuum-sealed foundation and the shipping container also help to maintain this configuration for storage, shipment, and delivery. The compact size of the folded, compressed vacuum-sealed foundation is a significant improvement over known mattress foundations that cannot be compressed and folded to such a compact state. Additionally, the compact foundation can be inserted into a shipping container for storage, shipment, and delivery.

The embodiments of the foam foundation were chosen and described to best explain the principles of the invention and its practical application to persons who are skilled in the art. As various modifications could be made to the exemplary embodiments, as described above, without departing from the scope of the invention, it is intended that all matter contained in the foregoing description and shown in the accompanying drawings shall be interpreted as illustrative rather than limiting. For example, although the crosswise rigid supports described with the several embodiments are lateral supports, and this allows for the most compact rolling of the foundation in the longitudinal direction around the lateral axis, it will be appreciated that longitudinal supports could also serve as the crosswise rigid supports, in which case the foundation would roll in the lateral direction around the longitudinal axis. Of primary importance to the crosswise supports is that they provide crosswise rigidity but they are not rigidly connected to each other and are only connected to each other through the single foam block. The present invention has additional advantages over the traditional mattress foundation.

What is claimed is:

1. A foundation for a mattress, comprising:

a foam block comprised of a top side, a bottom side, a head side, a foot side, a pair of side edges, a lateral width, and a foundation length, wherein the head side and the foot side are separated by the foundation length, wherein the pair of side edges are separated by the lateral width, wherein the foam block is further comprised of a unitary, flexible foam block with a plurality of channels recessed into the unitary foam block at its bottom side at spaced apart locations, wherein the foam block has a compressed configuration and an expanded configuration, wherein the top side and the bottom side are separated by a first thickness in the compressed configuration and a second thickness in the expanded configuration, and wherein the second thickness is greater than the first thickness; and a plurality of crosswise supports connected to the foam block at its bottom side, wherein the crosswise supports are rigid and span the lateral width between the pair of side edges, wherein the crosswise supports are connected to the bottom side of the foam block by at least one of an adhesive and a friction fit, wherein each one of the plurality of crosswise supports has a plurality of sides respectively contacting walls of the channels and an outer-facing side not in contact with the walls of the channels, wherein the crosswise supports are separated from each other by a distance, wherein no rigid connection extends between adjacent pairs of the crosswise supports, and wherein the distance has a range that is greater than the first thickness of the foam block and is less than the lateral width of the foam block.

2. The foundation of claim 1, wherein the adjacent pairs of the crosswise supports are flexibly connected to each other through contiguous portions of the foam block.

3. The foundation of claim 1, wherein the spaced apart locations of the plurality of channels correspond with the distance between the crosswise supports, wherein the channels span the entire lateral width between the pair of side edges.

4. The foundation of claim 3, wherein the outer-facing side is substantially flush with a surface of the bottom side of the foam block.

5. The foundation of claim 1, further comprising a cover comprised of a flame retardant material, wherein the cover envelops the foam block and the crosswise supports.

6. The foundation of claim 5, further comprising a vacuum-seal plastic membrane encasing the foam block, the crosswise supports, and the cover forming a packaged foundation assembly.

7. The foundation of claim 6, wherein the foam block has an opened arrangement and a folded arrangement, wherein portions of the foam block bend between the adjacent pairs of the crosswise supports in the folded arrangement, and wherein the head side of the foam block and the foot side of the foam block overlap a center section of the foam block in the folded arrangement.

8. The foundation of claim 7, wherein the foam block is in a planar form in the opened arrangement and is in the compressed configuration in the folded arrangement.

9. The foundation of claim 7, further comprising a shipping material surrounding the packaged foundation assembly when the foam block is in the folded arrangement.

10. The foundation of claim 1, wherein the foam block is further comprised of a flexible and compressible polyurethane foam material having an indentation force deflection between thirty-nine and ninety-five pounds per cubic foot.

11. A foundation for a mattress, comprising:

a foam block comprised of a top side, a bottom side, a head side, a foot side, a pair of side edges, a thickness, a lateral width, and a foundation length, wherein the head side and the foot side are separated by the foundation length, wherein the pair of side edges are separated by the lateral width, wherein the foam block has a compressed configuration and an expanded configuration, wherein the entire foam block is further comprised of a foam material having an indentation force deflection between thirty-nine and ninety-five pounds per cubic foot, wherein the top side and the bottom side are separated by a first thickness in the compressed configuration and a second thickness in the expanded configuration, and wherein the second thickness is greater than the first thickness;

a cover enveloping the foam block;

a vacuum-seal plastic membrane encasing the foam block and the cover when the foam block is in the compressed configuration forming a packaged foundation assembly, wherein the packaged foundation assembly has an opened arrangement and a folded arrangement, wherein the foam block has a planar form in the opened arrangement, and wherein the head side and the foot side of the foam block overlap a center section of the foam block in the folded arrangement; and a plurality of crosswise supports connected to at least one of the cover and the foam block at its bottom side, wherein the foam block is further comprised of a unitary, flexible foam material, wherein portions of the foam block connect and bend between adjacent pairs of the crosswise supports when in the folded arrangement, wherein the crosswise supports are rigid with a rigidity greater than the foam block, and wherein no rigid connection extends between the adjacent pairs of the crosswise supports, wherein the foam block is further comprised of a plurality of channels recessed into the foam block at its bottom side at spaced apart locations corresponding with the distance between the crosswise supports, wherein the channels span the entire lateral width between the pair of side edges, wherein each one of the plurality of crosswise supports has a plurality of sides respectively contacting walls of the channels and an outer-facing side not in contact with the walls of the channels, and wherein the plurality of the crosswise supports fit within the channels and are attached to the channels by at least one of an adhesive and a friction fit.

12. The foundation of claim 11, wherein the crosswise supports are separated by a distance, and wherein the distance has a range that is greater than the first thickness of the foam block and less than the lateral width of the foam block.

13. The foundation of claim 11, further comprising a shipping material surrounding the packaged foundation assembly in the folded arrangement, and a shipping container holding the packaged foundation assembly within the shipping material.

14. The foundation of claim 11, wherein the cover is comprised of a flame retardant material.

15. The foundation of claim 11, wherein the foam block has an indentation force deflection greater than thirty-nine pounds per cubic foot.

16. A foundation for a mattress, comprising:

a foam block comprised of a top side, a bottom side, a head side, a foot side, a pair of side edges, a lateral width, a foundation length, and a plurality of channels recessed into the bottom side, wherein the head side and the foot side are separated by the foundation length, wherein the pair of side edges are separated by the lateral width, wherein the foam block has a compressed configuration and an expanded configuration, wherein the top side and the bottom side are separated by a first thickness in the compressed configuration and a second thickness in the expanded configuration, wherein the second thickness is greater than the first thickness, wherein the channels span the entire lateral width between the pair of side edges, wherein the channels are at locations spaced apart by a distance, and wherein the distance has a range that is greater than the first thickness of the foam block and is less than the lateral width of the foam block;

a plurality of crosswise supports connected to the foam block within the channels, wherein the crosswise supports span the lateral width between the pair of side edges, wherein each one of the plurality of crosswise supports has an outer-facing side not in contact with walls of the channels, wherein the outer-facing side of each of the plurality of crosswise supports is substantially flush with a surface of the bottom side of the foam block, and wherein each one of the plurality of crosswise supports has a plurality of sides respectively contacting the walls of the channels;

a cover enveloping the foam block and the plurality of crosswise supports; and a plastic membrane encasing the foam block and the cover when the foam block is in the compressed configuration, wherein the foam block and the cover in the plastic membrane have an opened arrangement and a folded arrangement, wherein the foam block has a planar form in the opened arrangement, and wherein the head side and the foot side of the foam block overlap a center section of the foam block in the folded arrangement.

17. The foundation of claim 16, wherein the plurality of crosswise supports are connected to the bottom side of the foam block within the channels by at least one of an adhesive and a friction fit.

18. The foundation of claim 16, wherein the foam block is further comprised of a unitary, flexible foam material, and wherein portions of the foam block bend between adjacent pairs of the crosswise supports when in the folded arrangement.

* * * * *